US005302190A

United States Patent [19]

Williams

[11] Patent Number: 5,302,190

[45] Date of Patent: Apr. 12, 1994

[54] ELECTROSTATIC AIR CLEANER WITH NEGATIVE POLARITY POWER AND METHOD OF USING SAME

[75] Inventor: Tony G. Williams, Sanford, N.C.

[73] Assignee: Trion, Inc., Sanford, N.C.

[21] Appl. No.: 894,936

[22] Filed: Jun. 8, 1992

[51] Int. Cl.[5] ..... B03C 3/08

[52] U.S. Cl. ..... 95/57; 55/360; 95/78; 95/79; 96/66; 96/73; 96/75; 96/86; 210/748

[58] Field of Search ..... 55/2, 136, 138, 152, 55/360; 210/748; 95/57, 79, 78; 96/65, 72, 73, 80, 86, 87, 98, 70, 66, 75; 209/127.1, 129

[56] References Cited

U.S. PATENT DOCUMENTS

| | | | |
|---|---|---|---|
| 1,507,687 | 9/1924 | Schmidt | 55/2 |
| 2,662,608 | 12/1953 | Fields | 55/137 |
| 2,798,572 | 7/1957 | Fields | 55/137 |
| 2,973,055 | 2/1961 | Aitkenhead | 55/129 |
| 3,181,285 | 5/1965 | Tepolt et al. | 55/138 |
| 3,518,462 | 6/1970 | Brown | 55/138 X |
| 3,685,258 | 8/1972 | Kostel et al. | 55/129 |
| 3,704,572 | 12/1972 | Gourdine et al. | 55/126 |
| 3,988,131 | 10/1976 | Kanazawa et al. | 55/126 |
| 4,119,415 | 10/1978 | Hayashi et al. | 55/124 |
| 4,119,416 | 10/1978 | Hayashi et al. | 55/136 |
| 4,375,364 | 3/1983 | Van Hoesen et al. | 55/152 |
| 4,514,195 | 4/1985 | Coe, Jr. | 55/152 |
| 4,516,991 | 5/1985 | Kawashima | 55/124 |
| 4,789,801 | 12/1988 | Lee | 55/138 X |
| 5,037,456 | 8/1991 | Yu | 55/137 |
| 5,045,095 | 9/1991 | You | 55/139 |
| 5,055,118 | 10/1991 | Nagoshi et al. | 55/138 X |

*Primary Examiner*—Richard L. Chiesa
*Attorney, Agent, or Firm*—Burns, Doane, Swecker & Mathis

[57] ABSTRACT

An electronic air cleaner includes a housing having a fluid inlet and a fluid outlet for creating a fluid stream through the housing. Inside the housing is provided a set of first parallel conductive plates and a set of second parallel conductive plates, herein the first and second plates ar interspersed in an alternating fashion. An ionizer is provided on each of the second plates, and a source of negative high voltage is connected to each of the first plates. Particulate matter can be removed from the air stream in a method using the above-described electrostatic air cleaner.

20 Claims, 1 Drawing Sheet

ELECTROSTATIC AIR CLEANER WITH NEGATIVE POLARITY POWER AND METHOD OF USING SAME

BACKGROUND OF THE INVENTION

Field of the Invention

The present invention relates to electrostatic air cleaners.

Discussion of Related Art

A known electrostatic air cleaner includes an ionizer/collecting cell that includes a plurality of parallel grounded plates interspersed with parallel high voltage plates. Each of the high voltage plates has an ionizing wire at an upstream edge thereof and is charged with a positive high voltage so that an electric field is created that extends from the positive high voltage plates to the grounded plates. An air cleaner of this type is disclosed in U.S. Pat. No. 4,119,416. Because the high voltage plates in this type of air cleaner are charged with a positive high voltage, ozone generation is kept within an acceptable limit.

a In wire-and-plate type electrostatic precipitator cell, the degree of ozone generation depends on the polarity o the ionizing wire with respect to the nearby plates, provided that all other geometry is the same. If the wire polarity is negative with respect to the plates, particulate suspended in the air stream passing through this region will receive a negative charge, and the system is referred to as negative ionization. If the wire polarity is positive with respect to the plates, particulate suspended in the air stream passing through this region will receive a positive charge, and the system is referred to as positive ionization. For a particular voltage difference between the wire and plates, negative ionization will result in greater efficiency, and greater ozone generation.

Because negative ion emission has become a feature demanded by consumers, negative ion needles are sometimes added to electrostatic air cleaners to create desired negative ion emissions. If an air cleaner of the abovedescribed type is to include negative ion needles to create negative ion emissions, two sources of power are required for the air cleaner. A source of negative high voltage is required to power the negative ion needles, and a source of positive high voltage is required for the positive high voltage plates. The power sources can be a single high voltage power supply with dual outputs (i.e., one positive and one negative) or two separate power supplies (one positive and one negative). In either case, the requirement of two sources of high voltage power creates inefficiencies for the air cleaners.

To eliminate the requirement of two sources of power, another known type of air cleaner has been developed. Like the first described air cleaner, this other type of air cleaner includes a plurality of parallel grounded plates interspersed with a plurality of parallel plates that are charged with a high voltage. Each of the high voltage plates has an ionizer or ionizing wire at the upstream edge thereof. This second type of air cleaner is different from the first described cleaner in that the high voltage plates of the second type of air cleaner are charged with a negative high voltage, instead of a positive high voltage as used in the first described type of air cleaner. Air cleaners of this second type are disclosed in U.S. Pat. Nos. 3,704,572 and 3,988,131.

Air cleaners of this second type are advantageous because they require only one source of power—a negative high voltage source that can be used to power both the ionizer/collector cell of the air cleaner and negative ion needles used to create negative ion emissions. Another advantage of this second type of air cleaner is that it is more efficient to operate than an air cleaner that utilizes positively charged high voltage plates.

However, a disadvantage of the second type of air cleaner is that it generates an excessive amount of ozone.

SUMMARY OF THE INVENTION

It is, therefore, an Object of the present invention to provide an electrostatic air cleaner that utilizes a simple power source and that does not generate an excessive amount of ozone. An air cleaner according to the present invention includes a first plate, or set of plates, having an ionizer or ionizing wire at an upstream edge thereof, wherein both the plates and ionizer or ionizing wire are grounded. A second plate, or set of plates, that is parallel to the first plate is connected to a source of negative high voltage. If desired, negative ion needles can be also be included. Both the high voltage plates and the negative ion needles can then be connected to a single source of negative high voltage.

DETAILED DESCRIPTION OF THE PREFERRED EMBODIMENTS

Electrostatic precipitators, or electronic air cleaners, have been used for many years to remove particulate matter from fluid streams. Electronic air cleaners typically include an ionizer/collector cell mounted within a housing through which a fluid stream passes. The first, i.e., upstream, portion of the ionizer/collector cell is the ionizing region or discharge cell, which is followed by a collecting region or collector cell.

In general, the air cleaners operate by first passing the fluid stream containing the particulate matter therein through the ionizing region. In that region, the particulate matter is electrically charged. The fluid stream then continues through the collecting region, wherein the charged particulate matter is attracted to one or more collecting plates so that it may be removed from the fluid stream.

Figure 1:
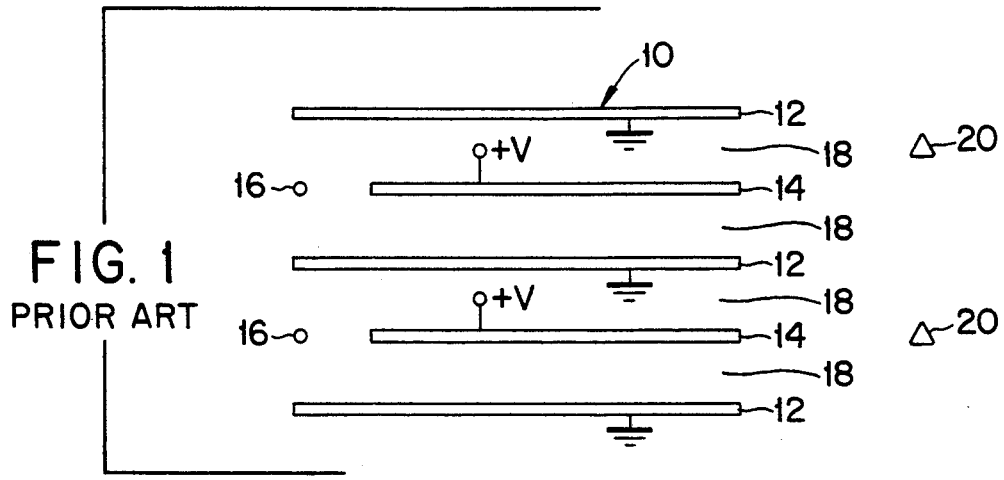
FIG. 1 PRIOR ART
FIG. 1 is a schematic illustration of a first type of prior art air cleaner.

An ionizer/collector cell 10 of a known air cleaner is illustrated in FIG. 1. A plurality of grounded, metallic plates 12 are set forth in a parallel fashion in parallel with the flow of a fluid stream that is directed through the ionizer/collector cell 10. Such plates are preferably made from aluminum, although they may be made from any suitable material.

Interspersed in parallel with and between the grounded plates 12 are a plurality of high voltage plates 14. The high voltage plates 14 are spaced from the grounded plates 12 so as to provide a plurality of air gaps 18 between the plates.

Figure 2:
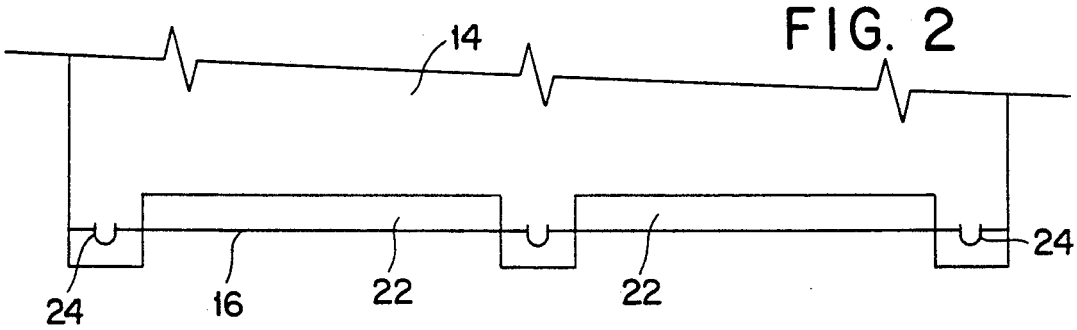
FIG. 2 is a side view of a high voltage plate having an ionizing wire mounted at an upstream edge thereof.

As illustrated in FIG. 2, the upstream edge of each high voltage plate 14 includes a plurality of relieved sections 22. An ionizing wire 16 is mounted by means of clips 24 so as to extend across the gaps 22 at the upstream edge of each high voltage plate 14.

Each of the high voltage plates 14, and thus also the ionizing wires 16, are connected to a source of positive high voltage. As particulate matter enters the ionizer/-collecting cell 10 from the left side of FIG. 1, the particulate matter is charged by the ionizing wires 16. As the charged particulate matter enters the air gaps 18 between the high voltage plates 14 and the grounded plates 12, the electric field created therebetween attracts the charged particulate matter to the grounded plates 12, from which the collected particulate matter is removed from the system.

Downstream of the ionizer/collector cell 10 are provided a plurality of negative ion needles 20 that are used to create negative ion emission from the air cleaner. A source of negative high voltage (not shown) must be provided to power the negative ion needles 20.

Because the high voltage plates 14 are charged with a positive high voltage, ozone emission from the known air cleaner is kept within an acceptable limit. However, a disadvantage of the air cleaner is that two high voltage power sources are required to power the air cleaner. A first, positive high voltage source is required to charge the high voltage plates 14, and a second, negative high voltage source is required to power the negative ion needles 20. Accordingly, the known air cleaner is not efficient to manufacture.

Figure 3:
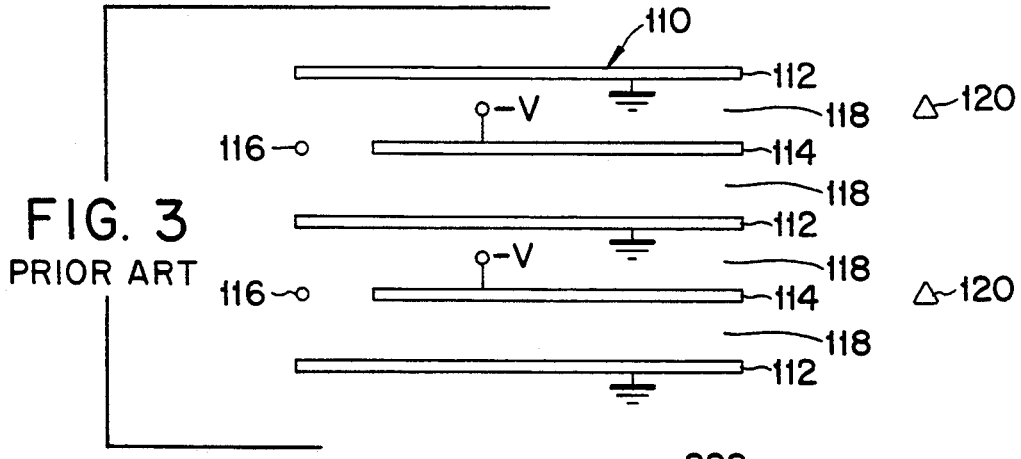
FIG. 3 PRIOR ART
FIG. 3 is a schematic illustration of a second type of prior art air cleaner.

In order to overcome the inefficiencies of the air cleaner illustrated in FIG. 1, a second type of prior art air cleaner has been developed. An ionizer/collector cell 110 for the second type of prior art air cleaner is illustrated in FIG. 3. The ionizer/collector cell 110 of FIG. 3 is substantially similar to that of FIG. 1 except that the high voltage plates 114 are connected to a source of negative high voltage. As a result, the ionizing wires 116 and the high voltage plates 114 are negatively charged and thus create an electric field extending from the grounded plates 112 to the ionizing wires 116 and the high voltage plates 114. The air cleaner may further include negative ion emission needles 120.

The ionizer/collector cell 110 of FIG. 3 operates by imposing a negative charge on particulate matter passing by the ionizing wires 116. As the charged particulate matter enters the air gaps 118 between the grounded plates 112 and the high voltage plates 114, the charged particulate matter is attracted to the grounded plates 112, and is thus removed from the fluid stream.

Negative ion emission needles 120 may be provided downstream of the ionizer/collector cell 110. An advantage of the type of air cleaner illustrated in FIG. 3 is that only one source of power (negative high voltage) is necessary to charge both the high voltage plates 114 and the negative ion needles 120. In addition, the ionizer/collector cell 110 is more efficient than the ionizer/collector cell 10 of FIG. 1 because it is charged with a negative high voltage.

The disadvantage of the system illustrated in FIG. 3 is that it generates considerably more ozone than the system illustrated in FIG. 1.

Thus, as can be seen from FIGS. 1 and 3, prior art ionizer/collector cells can be made to produce either positive ionization or negative ionization. If positive ionization is desired, a high voltage power supply with a positive output is selected, and its high voltage output is connected to the ionizing wires and the plates that support them. The ground terminal of the high voltage power supply is connected to the other plates of the ionizing/collecting cell. If negative ionization is desired, a high voltage power supply with a negative output is selected, and its high voltage output is connected to the ionizing wires and the plates that support them. The ground terminal of the high voltage power supply is connected to the other plates of the ionizing-/collecting cell. In other words, it has been known to connect the high voltage output of the power supply to the ionizing wires.

In order to take advantage of the efficiencies of the system of FIG. 3, while minimizing the generation of ozone the present invention was developed.

Figure 4:
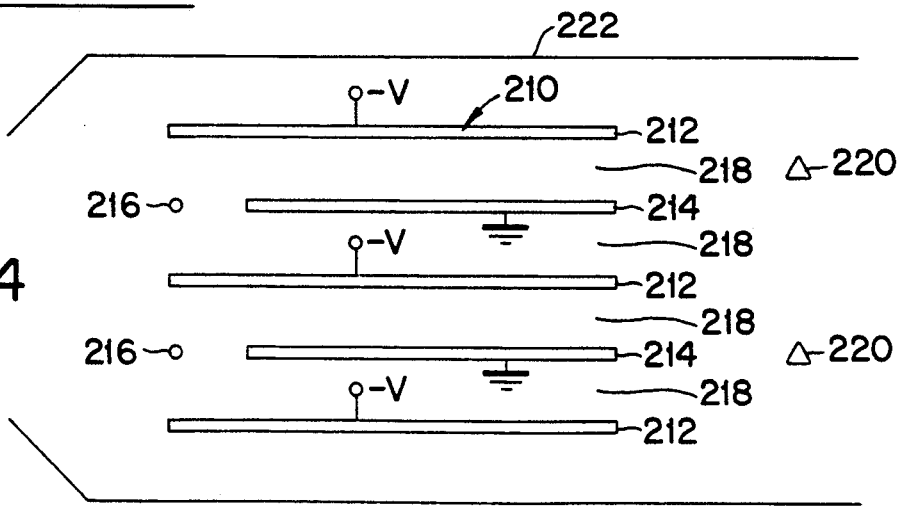
FIG. 4 is a schematic illustration of an air cleaner according to the present invention.

An ionizer/collector cell 210, in accordance with the present invention, is illustrated in FIG. 4. The ionizer/-collector cell 210 of FIG. 4 is similar to the ionizer/collector cell 110 of FIG. 3, except that the plates in the FIG. 3 embodiment that are grounded, are connected to a source of negative high voltage in the FIG. 4 embodiment, and the plates and ionizing wire of the FIG. 3 embodiment that were connected to a source of negative high voltage are grounded in the FIG. 4 embodiment.

Specifically, a plurality of flat plates 212 are arranged in parallel and in alignment with a fluid stream that passes through a housing 222. Between each of said flat plates 212 is arranged a parallel plate 214. The plates are preferably made of aluminum, although other conductive materials may also be used.

At the leading edge of each plate 214 is an ionizing wire 216. The ionizing wires 216 preferably have a rough surface in order to provide as much surface area as possible that is conducive to generating corona discharge. However, the rough surface of the wire is not a requirement.

As an alternative to the ionizing wire 216, any suitable type of ionizer may be used instead. For example, an elongated ionizing electrode having a saw-toothed edge may be used instead of the ionizing wire 216. Each of the tips of the saw-toothed edge functions as corona discharge points.

The leading edge of each plate 214 may include one or more recesses to accommodate the ionizing wire, as is illustrated by reference numeral 22 in FIG. 2 with respect to plate 14.

The plates 214, and the attached ionizing wires 216, are grounded, and a negative high voltage source is connected to each of the plates 212 so that an electric field is established that extends from the grounded plates 214 to the high voltage plates 212. In other words, the polarity of the wires 216 is positive with respect to the adjacent plates 212.

According to the present invention, a fluid stream containing particulate matter enters the housing 222 that contains the ionizer/collector cell 210 from the left side, as shown in FIG. 4. At the upstream end of the ionizer/collector cell 210, the particulate matter is positively charged. As the particulate matter continues to move through the air gaps 218 between the plates, the charged particulate matter is attracted to the negatively charged plates 212 for collection.

Because the plates 212 that are charged with the negative high voltage do not have an ionizing wire or any surfaces intentionally formed thereon to create a corona discharge, the generation of ozone is kept to an acceptable level.

In addition, if desired, negative ion needles 220 ca be provided downstream of the ionizer/collector cell 210. Because the high voltage plates 212 are charged with a source of negative high voltage, the same source of negative high voltage can also be used to power the negative ion needles 220. Accordingly, the present invention further has the advantage that only one source of high voltage power is necessary to drive both the ionizer/collector cell 210 and the negative ion needles 220.

Although only preferred embodiments are specifically illustrated and described herein, it will be appreciated that many modifications in variations of the present invention are possible in light of the above teachings and within the purview of the appended claims without departing from the spirit and intended scope of the invention.

I claim:

1. An electronic air cleaner, comprising:

a housing having a fluid inlet and a fluid outlet for creating a fluid stream through said housing;

a set of first parallel conductive plates within said housing;

a set of second parallel conductive plates within said housing, wherein said first and second plates are interspersed in alternating fashion;

a source of negative high voltage;

an ionizer provided on each of said second plates; and each of said first plates are connected to the source of negative high voltage and each of said second plates are grounded.

2. The electronic air cleaner of claim 1, wherein each of said second plates includes more surfaces for creating corona discharge than each of said first plates.

3. The electronic air cleaner of claim 1, wherein each of said ionizers includes an ionizing wire mounted at an upstream edge of each of said second plates.

4. The electronic air cleaner of claim 3, wherein said ionizing wires include irregular surfaces for creating corona discharge.

5. The electronic air cleaner of claim 32, wherein each of said second plates includes a recessed area in the vicinity of the ionizing wire.

6. The electronic air cleaner of claim 1, further comprising negative ion needles that are powered by said source of negative high voltage.

7. The electronic air cleaner of claim 1, wherein each of said ionizers is electrically connected to the second plate on which it is provided.

8. An ionizing/collector cell for an electrostatic air cleaner, comprising:

a first conductive plate;

a second conductive plate that is grounded and is arranged parallel to said first conductive plate so as to create an air gap therebetween;

said second conductive plate including more corona discharging surfaces on said second conductive plate than on said first conductive plate; and a source of negative high voltage electrically connected to said first conductive plate.

9. The ionizing/collector cell for an electrostatic air cleaner of claim 8, wherein said second conductive plate includes an ionizing wire mounted at an upstream edge of said plate.

10. The ionizing/collector cell for an electrostatic air cleaner of claim 8, further comprising a plurality of additional second conductive plates, each of which is grounded and includes more corona discharging surfaces than said first conductive plate and a plurality of additional first conductive plates, each of which is electrically connected to said source of high voltage, wherein said second conductive plates are alternately interspersed with said first conductive plates.

11. An ionizing/collector cell for an electrostatic air cleaner, comprising:

a first conductive plate;

a second conductive plate that is grounded and arranged parallel to said first conductive plate so as to create an air gap therebetween;

said second conductive plate including an ionizer at one end of said air gap, said ionizing being electrically connected to said second conductive plate; and means for using a negative high voltage to create an electric field extending from said second plate to said first plate.

12. The ionizing/collector cell for an electrostatic air cleaner of claim 11, wherein said second conductive plate includes an ionizing wire mounted at an upstream edge thereof.

13. An electronic air cleaner, comprising:

a housing having a fluid inlet and a fluid outlet for creating a fluid stream through said housing;

a set of first substantially parallel conductive plates within said housing;

a set of second substantially parallel conductive plates that are grounded and are arranged substantially parallel to said first conductive plates within said housing, wherein said first and second plates are interspersed in alternating fashion;

means on each of said second plates for creating a corona discharge, wherein each of said means for creating a corona discharge is electrically connected to the second plate on which it is provided; and means for using a negative high voltage to create an electric field extending from said second conductive plates to said first plates.

14. The electronic air cleaner of claim 13, further comprising a source of negative high voltage and each of said first plates are connected to the source of negative high voltage and each of said second plates are grounded.

15. The electronic air cleaner of claim 13, further comprising negative ion needles that are powered by said negative high voltage.

16. The electronic air cleaner of claim 13, wherein said corona discharge creating means includes an ionizing wire mounted at an upstream edge of each of said second plates.

17. A method of removing particulate matter from a fluid stream, comprising the steps of:

providing a housing having a fluid inlet and a fluid outlet;

creating a fluid stream through said housing;

providing in said housing a first conductive plate and a second conductive plate parallel to said first conductive plate, and providing on said second plate means for creating a corona discharge;

grounding said second conductive plate;

using a negative high voltage to create an electric field extending from said second conductive plate to said first plate;

moving the fluid stream through said housing and past said plates so that particulate matter in the fluid stream is charged and collected on said first plate.

18. The method of claim 17, wherein said using step includes applying a negative high voltage to said first plate.

19. The method of claim 17, and providing in said corona discharge creating mean an ionizing wire mounted at an upstream edge of said second plate.

20. The method of claim 17, further including the step of electrically connecting each of said means for creating a corona discharge to the second plate on which it is provided.

* * * * *